United States Patent [19]

Weigel et al.

[11] 4,292,283

[45] Sep. 29, 1981

[54] METHOD FOR THE RECOVERY OF ZINC

[75] Inventors: Horst Weigel, Cologne, Fed. Rep. of Germany; Jorge Lema-Patino, La Paz, Bolivia

[73] Assignee: Klöckner-Humboldt-Deutz AG, Fed. Rep. of Germany

[21] Appl. No.: 846,160

[22] Filed: Oct. 27, 1977

[51] Int. Cl.[3] ..... C01G 9/06; C22B 5/16

[52] U.S. Cl. ..... 423/107; 423/109

[58] Field of Search ..... 423/101, 102, 104, 107, 423/108, 109, 140; 204/118, 119; 75/120

[56] References Cited

U.S. PATENT DOCUMENTS

| | | | |
|---|---|---|---|
| 669,750 | 3/1901 | Jones | 423/107 |
| 1,255,440 | 2/1918 | Laist | 204/119 |
| 1,496,004 | 6/1924 | Laist | 75/120 |
| 1,912,590 | 6/1933 | Murray | 423/109 |

*Primary Examiner*—Brian E. Hearn

*Attorney, Agent, or Firm*—Hill, Van Santen, Steadman, Chiara & Simpson

[57] ABSTRACT

A method for the recovery of zinc from zinc oxide ores and/or roasted zinc sulfide or concentrates, wherein the zinc ore source is leached under substantially neutral conditions to produce a residue having a relatively high content of undissolved zinc, the residue is dried, and then suspended in a hot gas stream preferably in a smelting cyclone under reducing conditions to thereby volatilize off zinc and other readily volatile metals as their oxides. The oxide mixture thus produced is recovered and then subjected to a neutral leaching which selectively removes zinc values as well as other metal values.

3 Claims, No Drawings

METHOD FOR THE RECOVERY OF ZINC

BACKGROUND OF THE INVENTION

1. Field of the Invention

This invention is in the field of zinc metallurgy using a leaching process and a pyrometallurgical volatilization process to recover zinc values.

2. Description of the Prior Art

The industrial recovery of zinc by means of leaching and electrolysis has attained more and more importance since its development at the beginning of this century, particularly since high quality zinc ores are particularly amenable to the process and particularly with reference to their impurities or contaminants. Such impurities include iron and silicic acid as well as arsenic, antimony, cobalt, nickel, germanium, chlorine and fluorine. Since these elements are almost always included in the zinc minerals such as zinc blende or sphalerite, in the past fifty years the commercial utilization of the zinc electrolysis process had to deal with the problem of making these impurities innocuous.

The relative economy of the recovery of zinc by means of electrolysis depends to a large extent on whether it is possible to remove the impurities or contaminants by a combination of roasting and leaching.

When the zinc electrolysis method was first being utilized commercially, the refiner could still fall back upon particularly high quality in pure zinc ores and ore concentrates, and did not have to concern himself with the effect on the environment caused by depositing residues. Accordingly, only a simple neutral leaching was required in such instances. However, when zinc ores were reduced in quality and contained substantial amounts of iron, for example, and the refiner had to deal with fluctuations in the composition of the ore, the feasibility of utilizing the electrolysis method was problematical, if not actually partially uneconomical.

The problems involved begin with the primary leaching of the roasting material used. When the oxide zinc carrier material is treated with diluted sulfuric acid at a pH of about 3 to 4, the iron which had previously gone into solution after oxidation precipitates as ferric hydroxide. When the ferric hydroxide precipitates as a flocculent precipitates, it carries with it an appreciable part of the other contaminants such as arsenic, antimony and germanium. In order to achieve this important effect, however, additives must be added which decrease the probability that the zinc oxide contained therein is completely dissolved. Accordingly, outputs of only about 70 to 90% at the most were obtained, and the leaching residues remained with uneconomically high undissolved portions of zinc.

In order to cut down the cost of this type of process, it was then suggested that the recovery of zinc values could be improved by using several leaching steps connected in series with modified leaching and precipitation conditions, together with much higher acid concentrations in some stages, and increased temperatures as well as oxidation of the material in gaseous form. This method was particularly feasible after it was found that codissolved quantities of iron in the form of jarosite or goethite could be precipitated out of solution as an easily filterable residue under predetermined conditions.

With these types of methods, however, it was found that the multiple step leaching process required a very substantial amount of investment and operational costs.

For example, the leaching liquid must be thickened in a separate vaporization step to the required very much higher concentration for electrolysis. Furthermore, the plurality of leaching steps requires a very much more complex installation of apparatus in one leaching plant, leading to a very much more cumbersome installation in terms of supervision and control.

In addition, a particularly serious disadvantage resulted from the fact that the waste products produced in the case of the jarosite and/or goethite method was a material which provided appreciable problems in disposal because of the injurious nature of the substances contained therein such as arsenic, antimony, thallium, bismuth and the like. These materials are easily washed out of the residue by rain water and therefore when deposited in the open, contaminate the ground water. For these reasons, installations of the multiple step leaching of zinc ores today require considerable expenditures for the proper disposition of such residues, so that the economic advantages which previously existed are no longer present.

A different course was pursued with the pyrometallurgical treatment of the leaching residues. A series of treatment procedures were suggested, tested and put into large scale operation. The latter included rolling- and direct-rolling methods and extended through the most varied shaft, semi-shaft and sintering furnaces, with or without pre-compression of the feed. It was always the aim to improve the production of zinc with the hydrometallurgical leaching method by combination with the pyrometallurgical volatilization method whereby leaching and volatilization were employed in cyclic processes.

In accordance with this improved method, the leaching residue after drying with the addition of carbon, was mixed with slag forming additives at temperatures above 1000° C., and melted in a reducing atmosphere. The zinc content was volatilized as metal vapor, and subsequently oxidized in the gas stream and recovered again in dust collection aggregates. The non-volatile metallic and slag forming constituents resulted in a fusible or molten phase made of stone and slag. The high zinc containing oxide-sulfate dust recovered was again supplied to the leaching step.

Commencing in the 1950's, this method of treatment was regarded as disadvantageous for the reason that the dried leaching residue was present in pulverulent, very finely divided grains, requiring pelletizing, briquetting or sintering which added significantly to the cost. In addition, the thermal processes required expensive energy sources such as metallurgical coke or oil. Since the process involved a multistep thermal metal recovery it necessitated an increased size of production in the zinc plants which rendered the entire procedure uneconomical. These procedures were thus harmful to the environment, expensive in operation and maintenance and required high investment costs.

SUMMARY OF THE INVENTION

The present invention seeks to simplify the leaching process and to combine it with a thermal treatment for the leaching residue to achieve an optimal total production in zinc, with an innocuous waste material. In a simple one-step leaching method, with minimal cost, the portion of the readily soluble zinc recoverable from the roasting material is diverted into liquid phase. The solution residue rich in zinc, together with the additional metals is subjected to such a thermal process that the disadvantages of the earlier processes described above are not present.

As previously mentioned, a characteristic of the dried leaching residue is its extraordinary fine grained nature. In the case of the present invention, this property is economically made use of to achieve an advantageous treatment. In the present invention, after a neutral leaching of the zinc or roasting material, the leaching residue occurs with a high content of undissolved zinc. Subsequently this leaching residue is dried and under reducing conditions is brought into suspension with a hot gas stream. A portion of the zinc and a portion of the other readily volatilizable metals are precipitated as mixed oxides while the non-volatile metal and the metal combinations occur as a slag or stone. Finally, the mixed oxides are subjected to a neutral leaching. One of the advantages of carrying out the method according to the present invention is that the neutral leaching of the zinc ore roasting material is carried out in a single step.

A further advantage of the present invention is that the neutralization of the neutral leaching at a pH of about 5 and preferably about 5.5 is carried out for as long as iron precipitates from solution to provide a flocculent precipitate which carries with it metal ions of other metals present which are also precipitated.

In a particularly preferred embodiment of the present invention, pyrometallurgical treatment of the leaching residue is carried out in a smelting cyclone.

DESCRIPTION OF THE PREFERRED EMBODIMENTS

The present invention provides a simplified system in terms of method and apparatus so that the pyrometallurgical process is carried out under optimum conditions. With the pyrometallurgical process of the type provided by the present invention, it is possible to heat the finely grained, fluidized material spontaneously to a high smelting temperature on the order of 1450° C., whereby the thermal and chemical processes take place while the material is in freely suspended condition requiring the shortest treatment time with improved results. In comparison, for example, with a rolling furnace which requires a furnace chamber of 2 cubic meters per metric ton per day, with this melting cyclone, a reaction chamber of 1 cubic meter is sufficient for an output of about 25 metric tons per day. Thus the ratio of the reaction chambers is about 50 to 1 so that the investment cost reductions and space saving are considerable.

In a preferred form of the invention, the oxide mixtures recovered from the pyrometallurgical treatment separately from the zinc or roasting material are subjected to a neutral leaching in a weak sulfuric acid solution, whereby the main portion of the zinc oxide contained in the mixture goes into solution while a leaching residue occurs which contains the residual metallic values in suitable concentration for further processing. Consequently, by means of the separate leaching and precipitation process, the leaching and precipitation can be carried out under specific conditions for the recovery of valuable components which can be precipitated consecutively. One of the benefits of the method according to the present invention is that mixtures of oxides occur in the form of a combination having very fine particles with an optimum amount of active surface, lending these materials more favorably to the leaching and precipitation processes.

Another advantage of the present invention is that the method can be arranged so that the oxide mixtures during the primary leaching of the zinc roasting material are introduced near the end of the neutralization at a pH value of 2 and preferably greater than 2.

The invention will be more fully explained in connection with the following example.

A zinc ore roasting material was introduced into an agitated leaching vat, the material having the following composition:

| | | | |
|---|---|---|---|
| Zn | 47.52% | S | 29.28% |
| Cd | 0.20% | Mn | 0.23% |
| Pb | 1.08% | As | 0.03% |
| Cu | 0.44% | Ag | 151 g/metric ton |
| Fe | 11.80% | Residue | 3.50% |

The residue contained inert materials in the form of $SiO_2$, $Al_2O_3$, CaO, MgO, etc.

The roasting material was ground to a fineness of such that 70% was less than 75 microns (200 mesh) and was introduced into the leaching vat. The neutral leaching step commenced at a starting acid content of approximately 115 grams per liter of free sulfuric acid and was brought to a neutralization point for zinc sulfate at a pH of 5.5. The acid solution was treated with additional roasting material for as long as this pH value was maintained. The leaching temperature was in the range of 50° to 70° C. There was obtained a residue which after thickening amounted to about 490 kg., or 49% of 1 ton of roasting material.

The residue had the following composition, as dry material:

| | | | |
|---|---|---|---|
| ZnO | 14.8% | CuO | 0.71% |
| ZnS | 3.4% | CdO | 0.09% |
| $ZuSO_4$ | 6.2% | $As_2O_3$ | 0.24% |
| $ZnO \cdot Fe_2O_3$ | 50.6% | $MnO_2$ | 0.38% |
| $Fe(OH)_3$ | 8.7% | $Ag_2O$ | 600 g/t |
| $PbSO_4$ | 5.7% | Residue about | 3.20% |

The residue is composed of $SiO_2$, $Al_2O_3$, $CaSO_4$, MgO, etc.

The residue was dried to produce a finely grained pulverulent form. It was mixed with 30% by weight of finely ground coke dross of about 200 mesh and at the same time was introduced into a smelting cyclone in suspension in preheated air.

In addition to the already mentioned coke dross, additional amounts of silicon dioxide and iron sulfide can be added to the finely grained leaching residue to form slag and stone.

After leaving the smelting reactor, the gases and the molten products are separated. The hot gases go to an after-burning chamber where the carbon monoxide as well as the volatile metal vapors are oxidized with the introduction of an oxidizing gas. The gases then go through a cooler into a filter where the metal oxide dusts which are carried along and which contain volatile constituents in high concentration, are recovered as mixed oxides.

The smelting products collect in a settling hearth, in which a separation of slag and stone is completed. The stone contains the non-volatile metals, for example, copper nickel and precious metals in some concentration, while the gangue and the larger part of the iron appear in the slag.

The mixed oxides are the product of the following chemical reactions:

$FeS_2 \rightarrow FeS + \frac{1}{2}S_2$ $C + O_2 \rightarrow CO_2$ $CO_2 + C \rightarrow 2CO$ $ZnO + CO \rightarrow Zn + CO_2$ $ZnO + Fe_2O_3 + 2CO \rightarrow Zn + 2FeO + 2CO_2$ $ZnSO_4 + 4CO \rightarrow Zn + 4CO_2$ $ZnS + FeO + CO \rightarrow Zn + FeS + CO_2$ $PbSO_4 + 4CO \rightarrow PbS + 4CO_2$ $CdO + CO \rightarrow Cd + CO_2$ The after-burning of the metal vapor results in the following reactions:

$Zn + \frac{1}{2}O_2 \rightarrow ZnO$ $Cd + O_2 \rightarrow CdO$ $PbS + 3/2O_2 \rightarrow PbO + SO_2$ $PbS + \frac{1}{2}O_2 \rightarrow PbS + 2O_2 \rightarrow PbSO_4$ The oxide mixture which occurred in the dust collector had the following composition:

| | | | |
|---|---|---|---|
| ZnO | 75.3% | CdO | 0.9% |
| PbO | 13.3% | $As_2O_3$ | 0.8% |

The remaining 9.7% consists of impurities such as $Fe_2O_3$, C, $SiO_2$, etc.

These oxide mixtures as previously described, are subjected to a leaching precipitation, whereby the components can be separated relatively easily from one another.

It will be evident that various modifications can be made to the described embodiments without departing from the scope of the present invention.

We claim as our invention:

1. In a method for the recovery of zinc from zinc ores or concentrates in which said ores or concentrates are subjected to a primary leaching resulting in a leaching residue having a relatively high content of undissolved zinc and other metals, the residue is dried, suspended in hot gases under reducing conditions resulting in the volatilization of volatilizable zinc compounds and compounds of said other metals which are subsequently precipatated as mixed oxides, and oxide mixtures from pyrometallurgical treatment are subjected to a secondary leaching in a weakly acidic solution, the improvement which comprises:

recycling the mixed oxides to said primary leaching step, then through said volatilization step and then into said secondary leaching.

2. A method according to claim 1 in which said recycling is carried out continuously.

3. A method according to claim 1 in which said pyrometallurgical treatment is carried out in as melting cyclone.

* * * * *